United States Patent [19]

Matsushima et al.

[11] 4,017,334

[45] Apr. 12, 1977

[54] PROCESS FOR TREATING ALUMINUM CANS

[75] Inventors: Yasunobu Matsushima, Kawasaki; Hideo Oka, Yokohama; Katsuyoshi Noji, Ichikawa; Hiroyoshi Nakagawa, Yokohama, all of Japan

[73] Assignee: Oxy Metal Industries Corporation, Warren, Mich.

[22] Filed: Dec. 15, 1975

[21] Appl. No.: 641,050

Related U.S. Application Data

[63] Continuation-in-part of Ser. No. 511,404, Oct. 2, 1974, abandoned.

[30] Foreign Application Priority Data

Oct. 4, 1973 Japan ..... 48-110778

[52] U.S. Cl. ..... 148/6.15 R; 148/6.27; 148/31.5; 106/14

[51] Int. Cl.[2] ..... C23F 7/14

[58] Field of Search ..... 148/6.15 R, 6.27, 31.5; 106/14, 208; 427/435

[56] References Cited

UNITED STATES PATENTS

| | | | |
|---|---|---|---|
| 2,502,441 | 4/1950 | Dodd et al. | 148/6.27 |
| 2,813,814 | 11/1957 | Goodspeed et al. | 148/6.15 R |
| 2,854,368 | 9/1958 | Shreir | 148/6.15 R |
| 3,148,984 | 9/1964 | Harper | 148/6.15 R |

FOREIGN PATENTS OR APPLICATIONS

| | | | |
|---|---|---|---|
| 2,246,653 | 2/1975 | France | 148/6.15 R |
| 2,446,492 | 4/1975 | Germany | 148/6.15 R |

*Primary Examiner*—Ralph S. Kendall
*Attorney, Agent, or Firm*—Arthur E. Kluegel; Richard P. Mueller; Bertram F. Claeboe

[57] ABSTRACT

Disclosed is a process for treating aluminum wherein the surface is contacted with a solution containing phosphate, a tannin, titanium and fluoride prior to inking or lacquering. The process produces a coating exhibiting adhesion, color and corrosion resistance comparable to that obtained via conventional chromium-based processes without creating the pollution problems of chromium disposal.

13 Claims, No Drawings

PROCESS FOR TREATING ALUMINUM CANS

CROSS-REFERENCE TO RELATED APPLICATION

This application is a continuation-in-part of copending application U.S. Ser. No. 511,404 filed Oct. 2, 1974 now abandoned.

BACKGROUND OF THE INVENTION

This invention relates to the art of chemically treating an aluminum surface. It relates to improving the corrosion resistance and paint adhesion of an aluminum surface for manufacturing cans, structural materials for buildings, automobiles and electric goods. More specifically, it relates to the art of treating the surface of an aluminum can to improve both the corrosion resistance and the adhesion of an organic finish subsequently applied to the treated surface. This invention also concerns a process for accomplishing the foregoing results with an aqueous solution which has a less detrimental effect upon the environment than conventional treating solutions because it does not require the presence of chromium. The invention further relates to a composition of the above type which does not impart a noticeable color to the treated surface.

The term "aluminum" as used herein is meant to include alloys of at least 90 percent aluminum which are commonly employed in can manufacture. Such alloys may contain elements such as magnesium, manganese and zinc, for example. 3000, 5000 and 6000-type aluminums are suitable examples.

In the processing of aluminum cans after forming, the following procedure is typical:

1. wash with warm water;
2. clean, usually with an acid-type cleaner;
3. water rinse;
4. apply treatment chemical;
5. water rinse;
6. deionized water rinse;
7. dry;
8. apply decorative organic finish to the can exterior;
9. cure decorative organic finih at elevated temperature;
10. apply interior sanitary lacquer; and
11. cure interior sanitary lacquer.

As used herein, the term "organic finish" includes all organic films applied after step 4, for example: base coat, ink, paint, over-varnish and sanitary lacquer.

For step 4), standard practice is to employ an aqueous solution containing from one-half to one weight percent of a mixture of hexavalent chromium, phosphoric acid, and fluoride. Such treating solutions have produced satisfactory quality in terms of both corrosion resistance and paint adhesion. However, the chromium component is environmentally objectionable, and its use therefore entails additional recovery expense. It would, therefore, be highly desirable to be able to use a treating solution which would produce acceptable results which did not at the same time create the environmental problem of solutions containing chromium.

The following characteristics of an applied coating must be examined to determine its acceptability for use in aluminum can treatment:

1. corrosion resistance;
2. paint adhesion;
3. coating color and gloss;
4. required reaction time.

Testing for corrosion resistance and paint adhesion is performed as described prior to the examples. Coating color and gloss are rated visually. The color and gloss are important because the bottom of the can is not normally painted and because very often the decorative organic finish is applied to only a portion of the can surface allowing a portion of the aluminum surface to show through. Therefore, if the coating discolors the surface, the desired effect is not obtained. Finally, current manufacturing designs allow only very short reaction times (e.g., 20 seconds). Treating compositions which produce satisfactory results with respect to corrosion, adhesion and color must also do so within the permissible contact time.

The use of tannins in connection with metal treating has been suggested by the prior art. U.S. Pat. No. 2,502,441 discloses an alkali metal phosphatizing solution containing a two-component accelerator which may be used for the treatment of iron and steel surfaces and also possibly for other metals such as aluminum. The accelerator portion of the composition contains either a molybdenum or tungsten compound and a phenolic substance such as a tannin. The patentee notes, however, that if the alkali metal plus tannin is used without the molybdenum compound, deposition of a coating seems to be completely inhibited. Further, when either tungsten or molybdenum compounds are employed with fluoride to treat aluminum, objectionable discoloration of the surface occurs. U.S. Pat. No. 2,854,368 teaches the use of a phosphoric acid solution containing a tannin for the treatment of iron or steel and also possibly for other metals such as aluminum. The most dilute solution suggested by the patentee is one containing one mole of phosphoric acid and one weight percent tannin. When this solution was substituted for that of the present invention, completely unsatisfactory adhesions were obtained.

SUMMARY OF THE INVENTION

It has now been discovered that aluminum cans may be successfully treated to provide a paint receptive, non-corrosive, colorless coating with a contact time of 30 seconds or less. The clean aluminum surface is contacted with an aqueous solution containing phosphate, a tannin, titanium and fluoride at an acidic pH value prior to application of the organic finish.

DETAILED DESCRIPTION OF THE INVENTION

The chemistry of tannin agents is not completely understood. They include a large group of water soluble, complex organic compounds widely distributed throughout the vegetable kingdom. All have the common property of precipitating gelatin from solutions and of combining with collagen and other protein matter in hides to form leather. All tannins examined contain mixtures of polyphenolic substances and normally have associated with them certain sugars. (It is not known whether these sugars are an integral part of the structure.) For a discussion of tannins, see *Encyclopedia of Chemical Technology*, 2nd edition, Kirk-Othmer; Xii (1967) pp. 303–341 and *The Chemistry and Technology of Leather*, Reinhold Publishing Corporation, New York, pp. 98–220 (1958).

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often extracts are mixed and contain both hydrolyzable and condensed form. No two tannin extracts are exactly alike. Principal sources of tannin extracts include bark such as wattle, mangrove, oak, eucalyptus, hemlock, pine, larch, and willow; woods such as quebracho, chestnut, oak, and urunday, cutch and turkish; fruits such as myrobalans, valonia, divi-divi, tera, and algarrobilla; leaves such as sumac and gambier; and roots such as canaigre and palmetto. Common names of such extracts include depside, chinese, turkish, hamamel, chebulinic, sumac, gallo and ellagitannins.

The term "vegetable tannins" is employed to distinguish organic tannins such as those listed in the previous paragraph from the mineral tanning materials such as those containing chromium, zirconium and the like. Experimental work has shown that hydrolyzable, condensed, and mixed varieties of vegetable tannins may all be suitably used in the present invention. Quebracho extract and Tannic Acid in accordance with Japanese Industrial Standard K8629 hve been found very effective.

Very small concentrations of the tannin have been found effective for improving the corrosion resistance and organic finish adhesion of an aluminum surface. The concentration to be used in a particular instance depends upon the particular tannin employed, the processing conditions selected and the quality and thickness desired of the resulting coating. The tannin is used in a concentration of from 0.01 to 10 g/l, preferably from 0.1 to 10 g/l and most preferably about 0.2. Lower concentrations do not produce an appreciable improvement in characteristics, and higher concentrations result in an increased dragout of valuable chemicals on the workpieces.

The titanium compounds which may be employed as a source of titanium include hydrofluotitanic acid and its alkali metal or ammonium salts as well as titanium sulfate and the like. The compound should be added to the treating solution in an amount sufficient to provide from 0.01 to 10, preferably 0.1 to 1 g/l, and most preferably about 0.1 g/l of Ti equivalent.

The fluoride concentration should be 0.01 to 10, preferably 0.01 to 5 g/l, and most preferably about 0.5 g/l. The titanium and fluoride components may be provided by a single compound such as $K_2TiF_6$ or as separate compounds. Thus, the fluoride may be provided in the form of a simple fluroide such as hydrofluoric acid, sodium acid fluoride, a complex fluoride such as fluosilicic or fluoboric acids or their ammonium or alkali metal salts. At a fluoride concentration higher than 10 g/l, excessive etching occurs and prevents the formation of a satisfactory coating.

The phosphate component may be employed in a concentration effective to improve the coating quality, and normally ranges from 0.01 to 50 g/l and preferably from 0.05 to 50 g/l as phosphate. When used in a concentration lower than 0.01 g/l, uniform coating with good corrosion resistance is difficult to obtain and the stability of the treating solution becomes poor. At a concentration higher than 50 g/l, no additional effect on the formation of film and corrosion resistnce can be observed. Lower concentrations, e.g. 0.05 g/l, are normally sufficient.

Suitable sources of phosphate for the solution include phosphoric acid and the various sodium, potassium or ammonium phosphate salts. The solution may optionally include a polyphosphoric acid, such as pyrophosphoric acid, tripolyphosphoric acid, hexametaphosphoric acid or a sodium or potassium salt thereof; an organophosphate compound such as phytic acid; nitrodiethanolethylene sulfonic acid; phosphonate compounds such as 2-hydroxyethylmethacryl-1-acid, phosphonic acid, 2-ethylhexyl acid phosphonic acid, ethane-1-hydroxy-1, 1-diphosphonic acid. In order to formulate the solution for forming a chemical conversion coating, the tannin and titanium compound are dissolved in an aqueous acidic solution comprising alkali metal phosphate and/or phosphoric acid. The first two components may be mixed with the phosphating solution at the same time or separately in solid or liquid state. The pH of the aqueous treating solution must be acidic and is preferably adjusted to a value of at least 1.2 and less than about 5.5 and most preferably between 3 and 4. A pH somewhat on the acid side (as low as about 3) is typically obtained when a natural extract is dissolved in water and the solution is normally below a pH of 1.2 if $H_2TiF_6$ or similar acidic materials are employed as a source of titanium or fluoride. Adjustment with an alkaline material is then necessary. The pH may be adjusted with any compatible acid or base typically used for that purpose such as, hydrochloric, sulfuric, phosphoric, hydrofluoric, chromic or acetic acids and ammonium or alkali metal hydroxides, carbonates or silicates. Only very small amounts are necesary.

If desired, the treating solution may be initially prepared in concentrated form for reasons of economy. The components of the concentrate may be dissolved in water in weight ratios corresponding to those desired in the solution when diluted for use. Suitable ratios of tannin: titanium: fluoride: phosphate are 1:0.001–1000:0.001–1000: 0.001–5000, preferably 1:0.001–10:0.01–50:0.005–50 and most preferably about 1:0.5:3:0.3. If desired, the foregoing concentrate may be prepared in two or more packages which if combined in appropriate ratios will yield a concentrate equivalent to the above.

The processing conditions of temperature, contact time, and contact method are interdependent; spray, immersion, and roll-on techniques may be employed. In the case of can manufacture, application of the chemicals is conventionally by the spray technique and, considering normal plant operations, the temperature of the solution will normally be from 30 to 90° C (preferably 35°–45° C) and the contact time will be between 5 and 30 seconds and usually less than 20 seconds.

In practice, the severest problems of discoloration of an unfinished surface will be encountered during pasteurizing. Typically, no organic finish is applied to the can bottom to protect it from corrosion. If left untreated, it will discolor during pasteurization, turning brownish.

The adhesion of the organic finish to the surface normally meets its severest test when the cans are subjected to a hot detergent solution to sanitize the cans before filling.

Accordingly, tests have been developed to measure the bare surface corrosion resistance and finish adhesion imparted to a can by a particular treating procedure. In the corrosion test, the can is immersed in tap water and subjected to temperatures of 60° to 70° C for 45 minutes. Then the unpainted portion is observed for discoloration. Since pasteurization normally takes about 15 minutes, this test is somewhat more severe than would be encountered in practice. In the adhesion test, the can is subjected to a boiling one percent detergent (Joy, Proctor & Gamble) solution, rinsed in tap water, cross-hatched with a knife, dried, and tape-pulled. The percent of paint removed from the surface and adhering to the transparent tape is the measured as an indication of the adhesion.

The following examples demonstrate the process of the invention. In all cases, the aluminum cans were pretreated as follows:

1. 15 sec. hot water rinse;
2. 30 sec. spray cleaning using a sulfuric acid-based cleaner;
3. 15 sec. hot water rinse;
4. spray application of treating solution;
5. 15 sec. cold water rinse;
6. 3 min. oven dry at 350° F.

Coke red ink (Acme Ink Co. alkyd-based) was then applied using rubber rolls. Next, clear overvarnish (Clement Coverall Co., Code No. P-550-G alkyd polyester) was applied over the wet ink using a No. 5 draw down bar. The cans were then baked 5 min. at 350° F followed by 3 min. at 410° F to cure.

COMPARATIVE EXAMPLE A

A solution was prepared in acordance with Example 1 of U.S. Pat. No. 2,502,441 to contain:

| | |
|---|---|
| $NaH_2PO_4$ | 13.5 g/l |
| $MoO_3$ | .15 g/l |
| Quebracho | .08 g/l |
| pH adjusted to about 5.0 | |

The solution was used as the treating solution in the above procedure at a temperature of about 55° C for either 20 seconds or one minute. The coating obtained appeared dull and nonadherent. After the organic finish was applied as above, the can was subjected to the pasteurization and adhesion tests. In the pasteurization test, the surface was grossly discolored and in the adhesion test, almost complete paint removal was observed indicating unacceptable adhesion.

COMPARATIVE EXAMPLE B

To the above solution was added 0.4 g/l of fluoride as HF. When used to treat aluminum cans for either 20 seconds or one minute, a coating was obtained which was dusty-brownish and non-adherent. Adhesion and pasteurization test results were unacceptable. Again, almost complete paint removal occurred in the adhesion test.

EXAMPLE 1

To the above fluoride containing solution was added 0.2 g/l of Ti as $Ti(SO_4)_2$ and cans treated for either 20 seconds or one minute. The resulting coating was colorless, non-dusty and acceptable pasteurization and adhesion results (essentially no paint removal) were obtained.

COMPARATIVE EXAMPLE C

If the titanium is added to the solution of Comparative Example A, acceptable coatings cannot be obtained within a minute or less because of the absence of the fluoride accelerator.

EXAMPLE 2

A solution was prepared to contain:

| | |
|---|---|
| $PO_4$ as $H_3PO_4$ | .4 g/l |
| Ti as $H_2TiF_6$ | .7 g/l |
| Quebracho | 2 |
| F as $H_2TiF_6$ | 1.7 |
| pH | 1.2 to 5.5 |

Aluminum cans were treated for 20 seconds as above. The coating was shiny and colorless. Adhesion and pasteurization results were excellent.

What is claimed is:

1. In a process for treating aluminum to impart corrosion resistance and paint adhesion to the surface thereof, the improvement comprising treating the surface with an aqueous solution having an acidic pH and containing in dissolved form:
a vegetable tannin: 0.01 – 10 g/l
a titanium compound: 0.01 – 10 g/l as Ti
a fluoride compound: 0.01 – 10 g/l as F
a phosphate compound: 0.01 – 50 g/l as $PO_4$

2. The process of claim 1 wherein the solution contains:
a vegetable tannin: 0.1 – 10 g/l
a titanium compound: 0.01 – 1 g/l as Ti
a fluoride compound: 0.1 – 5 g/l as F
a phosphate compound: 0.05 – 5 g/l as $PO_4$

3. The process of claim 1 wherein the solution is contacted with the aluminum surface for a period of 5 – 30 seconds.

4. The process of claim 1 wherein the pH value of the solution is from 1.2 to 5.5.

5. The process of claim 1 wherein the solution contains:
a vegetable tannin about 0.15 g/l
a titanium compound about 0.07 g/l as Ti
a fluoride compound about 0.5 g/l as F
a phosphate compound about 0.05 g/l as $PO_4$

6. A corrosion resisting aqueous acidic composition suitable for imparting improved corrosion resistance and paint adhesion to an aluminum surface which composition comprises in dissolved form;
a vegetable tannin: 0.01 – 10 g/l
a titanium compound: 0.01 – 10 g/l as Ti
a fluoride compound: 0.01 – 10 g/l as F
a phosphate compound: 0.01 – 50 g/l as $PO_4$

7. The composition of claim 6 comprising:
a vegetable tannin: 0.1 – 10 g/l
a titanium compound: 0.01 – 1 g/l as Ti
a fluoride compound: 0.1 – 5 g/l as F
a phosphate compound: 0.5 – 5 g/l as $PO_4$
and exhibiting a pH of from 1.2 to 5.5.

8. The composition of claim 7, comprising:
a vegetable tannin about 0.15 g/l
a titanium compound about 0.07 g/l
a fluoride compound about 0.5 g/l
a phosphate compound about 0.05 g./l

9. An aqueous concentrate composition, suitable for treating an aluminum surface when diluted with water comprising in dissolved form a vegetable tannin, a titanium compound, a fluoride compound and a phosphate compound in a weight ratio of tannin:titanium:fluoride:phosphate of 1 : 0.001–1000 : 0.001–1000 : 0.001–5000.

10. The concentrate of claim 9 wherein the ratio is 1 : 0.001–10 : 0.01–50 : 0.005–50.

11. The concentrate of claim 10 wherein the ratio is about 1 : 0.5 : 3 : 0.3.

12. The modified aluminum surface obtained by the process of claim 1.

13. The modified aluminum surface obtained by the process of claim 5.

* * * * *

UNITED STATES PATENT AND TRADEMARK OFFICE

CERTIFICATE OF CORRECTION

PATENT NO. : 4,017,334

DATED : April 12, 1977

INVENTOR(S) : Yasunobu Matsushima et al

It is certified that error appears in the above—identified patent and that said Letters Patent is hereby corrected as shown below:

Cover Page, Under Title "Foreign Application Priority Data", delete "48-110778" and insert ---- 48-110978 ----

Signed and Sealed this

*Twenty-seventh* Day of *April 1982*

[SEAL]

*Attest:*

GERALD J. MOSSINGHOFF

*Attesting Officer*

*Commissioner of Patents and Trademarks*